US009684283B2

(12) United States Patent
Stranczl et al.

(10) Patent No.: US 9,684,283 B2
(45) Date of Patent: Jun. 20, 2017

(54) PIVOT FOR TIMEPIECE MECHANISM

(71) Applicant: NIVAROX-FAR S.A., Le Locle (CH)

(72) Inventors: Marc Stranczl, Nyon (CH); Thierry Hessler, St-Aubin (CH); Jean-Luc Helfer, Le Landeron (CH)

(73) Assignee: Nivarox-FAR S.A., Le Locle (CH)

( * ) Notice: Subject to any disclaimer, the term of this patent is extended or adjusted under 35 U.S.C. 154(b) by 0 days.

(21) Appl. No.: 14/764,080

(22) PCT Filed: Feb. 13, 2014

(86) PCT No.: PCT/EP2014/052784
§ 371 (c)(1),
(2) Date: Jul. 28, 2015

(87) PCT Pub. No.: WO2014/146832
PCT Pub. Date: Sep. 25, 2014

(65) Prior Publication Data

US 2016/0041526 A1 Feb. 11, 2016

(30) Foreign Application Priority Data

Mar. 19, 2013 (EP) ..... 13160026

(51) Int. Cl.

| | |
|---|---|
| ***G04B 31/00*** | (2006.01) |
| ***G04B 31/02*** | (2006.01) |
| ***G04B 31/04*** | (2006.01) |
| ***G04B 31/06*** | (2006.01) |
| ***G04B 29/04*** | (2006.01) |
| ***G04B 43/00*** | (2006.01) |
| ***G04B 31/004*** | (2006.01) |
| ***G04B 31/016*** | (2006.01) |
| ***G04B 29/02*** | (2006.01) |

(52) U.S. Cl.
CPC ..... *G04B 31/02* (2013.01); *G04B 29/02* (2013.01); *G04B 29/04* (2013.01); *G04B 31/004* (2013.01);
(Continued)

(58) Field of Classification Search
CPC .... G04B 29/04; G04B 31/004; G04B 31/016; G04B 31/02; G04B 31/04; G04B 31/06; G04B 43/002
(Continued)

(56) References Cited

U.S. PATENT DOCUMENTS

| | | | | |
|---|---|---|---|---|
| 2,538,142 A * | 1/1951 | Zurcher | ..... | G04B 31/04 368/326 |
| 3,278,245 A * | 10/1966 | Matthey | ..... | G04B 31/04 384/243 |
| 2002/0114225 A1* | 8/2002 | Damasko | ..... | G04B 15/14 368/125 |
| 2013/0188462 A1 | 7/2013 | Helfer et al. | | |

FOREIGN PATENT DOCUMENTS

| | | | |
|---|---|---|---|
| CH | 235315 A * | 11/1944 | ..... G04B 31/02 |
| CH | 272618 A * | 12/1950 | ..... G04B 31/02 |

(Continued)

OTHER PUBLICATIONS

Loretan, Edouard, CH 1514473 English Translation, originally published Jan. 30, 1976, whole document.*

(Continued)

*Primary Examiner* — Amy Cohen Johnson
*Assistant Examiner* — Daniel Wicklund
(74) *Attorney, Agent, or Firm* — Oblon, McClelland, Maier & Neustadt, L.L.P.

(57) ABSTRACT

A pivot for a timepiece mechanism, including a first rotational guide member for radially holding an arbor in a plate, and a second front guide member for axially limiting an end of the arbor, and including at least one resilient shock absorber acting on at least the first rotational guide member and/or the second front guide member. The resilient shock absorber is made in a one-piece manner in a micromachinable material or in silicon or quartz or diamond with a structural element other than the first rotational guide member and the second front guide member.

11 Claims, 3 Drawing Sheets

(52) U.S. Cl.
CPC ..... *G04B 31/016* (2013.01); *G04B 31/04* (2013.01); *G04B 31/06* (2013.01); *G04B 43/002* (2013.01)

(58) Field of Classification Search
USPC ..... 368/125, 215, 216
See application file for complete search history.

(56) References Cited

FOREIGN PATENT DOCUMENTS

| | | | | | |
|---|---|---|---|---|---|
| CH | 1514473 | A4 * | 1/1976 | ..... | G04B 31/04 |
| CH | 700 496 | B1 | 9/2010 | | |
| DE | 902598 | C * | 1/1954 | ..... | G04B 31/02 |
| EP | 2 015 147 | A2 | 1/2009 | | |
| EP | 2 400 355 | A1 | 12/2011 | | |
| EP | 2 607 971 | A1 | 6/2013 | | |
| GB | 586403 | A * | 3/1947 | ..... | G04B 31/04 |
| WO | WO 2009/060074 | A1 | 5/2009 | | |
| WO | WO 2011/161139 | A1 | 12/2011 | | |

OTHER PUBLICATIONS

Pierre et al., WIPO 2009/060074 English Translation, orginially publsihed May 14, 2009, whole document.*
International Search Report issued Jun. 10, 2014, in PCT/EP2014/052784 filed Feb. 13, 2014.

* cited by examiner

PIVOT FOR TIMEPIECE MECHANISM

CROSS-REFERENCE TO RELATED APPLICATIONS

This is a National phase application in the U.S. of International patent application PCT/EP2014/052784 filed Feb. 13, 2014 which claims priority on European patent application No. 13160026.4 filed Mar. 19, 2013. The entire disclosures of the above patent applications are hereby incorporated by reference.

FIELD OF THE INVENTION

The invention concerns a pivot for a timepiece mechanism, including a first rotational guide member for radially holding an arbor in a plate, and a second front guide member for axially limiting the end of said arbor, and including at least one resilient shock absorber acting on at least said first rotational guide member and/or said second front guide member, wherein said at least one resilient shock absorber is made in a one-piece manner in a micromachinable material or silicon or quartz or diamond or ruby or corundum with at least one structural element other than said first rotational guide member and said front guide member.

The invention also concerns a timepiece plate fitted with at least one pivot of this type.

The invention also concerns a mechanical timepiece movement including at least one plate of this type.

The invention concerns the field of timepiece mechanisms, and more specifically the pivoting of timepiece wheel sets.

BACKGROUND OF THE INVENTION

The pivoting of timepiece wheel sets has a crucial effect on the quality of the movements. It is expensive to produce pivots, in terms of the number and cost of components and the machining costs of high precision geometric implementations, and the assembly of jewels and shock absorber devices requires particular care.

Conventionally, a pivot for the pivotal guiding of the end of an arbor includes a cabochon housed in a bore or counterbore of the plate, the cabochon containing, housed together in a jewel-setting, a radial guide jewel for the arbor and a support endstone for the axial end of the arbor, and at least one shock absorber device such as a suspension ring for the jewels or jewel-setting. The need for lubrication requires the presence of an oil-pot whose shape must ensure lubrication in any position.

CH Patent No 700496B1 in the name of PATEK PHILIPPE discloses a shock absorber bearing with an elastic means acting axially on a jewel hole comprising a hole for receiving a pivot, and a guide means, which is formed by said elastic means, to force the jewel hole to move only axially, against elastic return means.

EP Patent Application No 2015147A2 in the name of ULYSSE NARDIN discloses a shock absorber bearing including a pivoting member with at least one resilient arm and a central portion including a hole for receiving a pivot, which are formed in a single-piece in a disc of single crystal material.

WO Patent Application No 20111161139A1 in the name of SWATCH GROUP R&D discloses a shock absorber bearing for a wheel set arbor including a pivot-shank extended by a pivot, comprising a support provided with a housing arranged for receiving a suspended pivot system into which the pivot-shank is inserted. The pivot system absorbs any shocks that the wheel set undergoes and is formed in a single-piece made of an at least partially amorphous metal alloy. EP Patent Application No 2400355A1 in the name of SWATCH GROUP R&D also discloses a bearing fulfilling the same function which includes elastic means, arranged to exert at least an axial force on the pivot system, and made of an at least partially amorphous material.

EP Patent Application No 2607971A1 in the name of SWATCH GROUP R&D discloses a method of producing a bearing including a recess, in a substrate, wherein the structure of one area of the substrate is modified in order to make it more selective, wherein this area is chemically etched to produce the bearing, wherein the substrate is made of laser wavelength transparent material, wherein at least one recess is used to form a resilient structure, which includes a central part arranged so that the pivot-shank of an arbor can be inserted therein and at least one resilient arm extending from said central part.

SUMMARY OF THE INVENTION

Therefore, the invention proposes to provide a pivot with a reduced number of components, which is highly reliable, preferably operating without lubrication, with good absorption qualities and precise repositioning qualities after a shock.

For this purpose, the present invention uses new technologies for fabricating micro-components, MEMS, "LIGA", lithography, and suchlike, to optimise the fabrication of this type of pivot.

To this end, in a first preferred embodiment, the invention concerns a pivot for a timepiece mechanism, including a first rotational guide member for radially holding an arbor in a plate, and a second front guide member for axially limiting the end of said arbor, and including at least one resilient shock absorber acting on at least said first rotational guide member and/or said second front guide member, wherein said at least one resilient shock absorber is made in one-piece in a micromachinable material or silicon or quartz or diamond or ruby or corundum with at least one structural element other than said first rotational guide member and said front guide member, characterized in that the pivot has a first level and a second level which are superposed, in that on said first level said first rotational guide member is suspended from said structural element via at least a first shock absorber, and in that on said second level said second front guide member is suspended from said structural element via at least a second shock absorber.

According to a feature of the invention, said at least one resilient shock absorber is made in one-piece with said second front guide member.

According to a feature of the invention, said at least one resilient shock absorber is made in one-piece with said first rotational guide member.

According to a feature of the invention, said at least one resilient shock absorber is made in one-piece with said second front guide member and with said first rotational guide member.

According to a feature of the invention, said pivot forms an independent pivot assembly, and said structural element is a cabochon including at least one bearing surface arranged to cooperate with one said plate.

According to a feature of the invention, at least said first rotational guide member or said second front guide member includes a guide surface for said arbor coated with a hard coating or DLC.

In a second embodiment, the invention concerns a pivot for a timepiece mechanism including a first rotational guide member for radially holding an arbor in a plate, and a second front guide member for axially limiting the end of said arbor, and including at least one resilient shock absorber acting on at least said first rotational guide member and/or said second front guide member, characterized in that at least said first rotational guide member or said second front guide member is made in a one-piece manner in a micromachinable material or silicon or quartz or diamond or ruby or corundum with at least one structural element other than said first rotational guide member and said front guide member.

The invention further concerns any combinations integrating several conventional pivot components in a single-piece.

The invention also concerns a timepiece plate comprising at least one pivot of this type.

According to a feature of the invention, said plate forms said structural element for at least one said pivot comprised therein.

According to a feature of the invention, at least said first rotational guide member or said second front guide member is made in one-piece with said plate in a micromachinable material or silicon or quartz or diamond or ruby or corundum.

According to a feature of the invention, said first rotational guide member and said second front guide member are both made in one-piece with said plate.

The invention also concerns a mechanical timepiece movement including at least one plate of this type.

Making monolithic components, in particular with the plate, has the advantage of reducing the number of parts, and avoiding assembly problems. The invention benefits from the precision with which these monolithic components are made (typically, the parts are for example made of silicon and therefore enjoy micrometric precision).

The monolithic plate integrating the pivots has the main advantage of guaranteeing the distances between centres and of forming a ready-to-use precise base for a mechanism, in particular an oscillator in a preferred application.

The invention incorporates, in particular, flexible guide members, which have the following advantages:

guaranteed precision;

very reduced or zero friction level;

no lubrication;

no play;

no wear.

The fabrication of these flexible guide members results in limitations, notably a limited travel, low return forces, and a limited load. However, these limitations are not prohibitive for a number of horological functions, in particular those which relate to regulation and here, guide members for jewels with a limited travel.

These limitations are amply compensated by the high precision of the distance between centres, the small number of components to be made and hence the reduced complexity and assembly time. A plate including at least one pivot according to the invention thus has great industrial advantage.

BRIEF DESCRIPTION OF THE DRAWINGS

Other features and advantages of the invention will appear upon reading the following detailed description, with reference to the annexed drawings, in which.

DETAILED DESCRIPTION OF PREFERRED EMBODIMENTS

Figure 1:
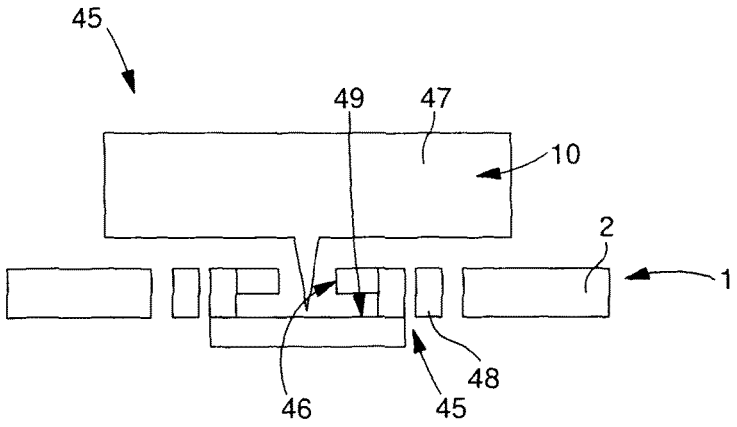
FIG. 1 shows a cross-section through the arbor of a pivot with a shock absorber bearing in one-piece with a plate.
Figure 2:
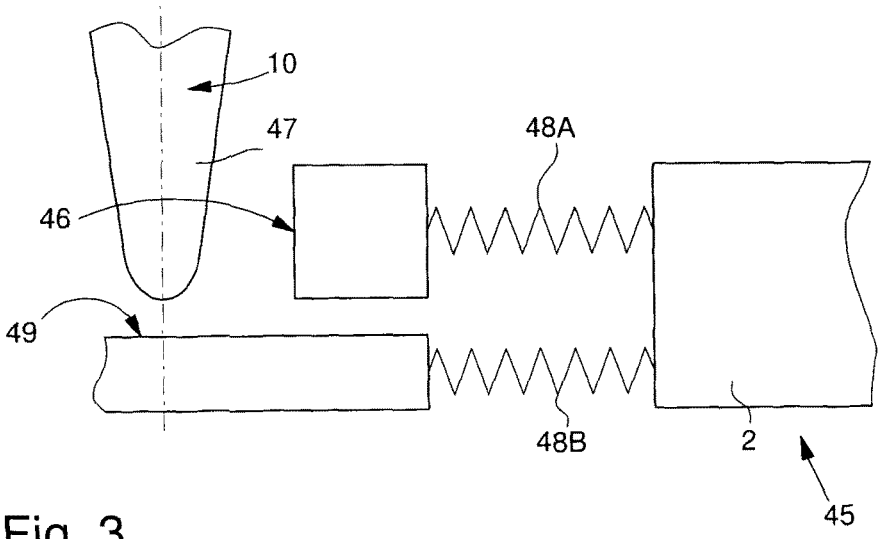
FIG. 2 shows, in a similar manner to FIG. 1, a pivot with a first rotational guide member for radially holding an arbor, suspended from the plate by a first upper shock absorber at a first upper level, and with a second front guide member for limiting the end of an arbor, suspended from the plate by a second lower shock absorber at a second lower level.
Figure 3:
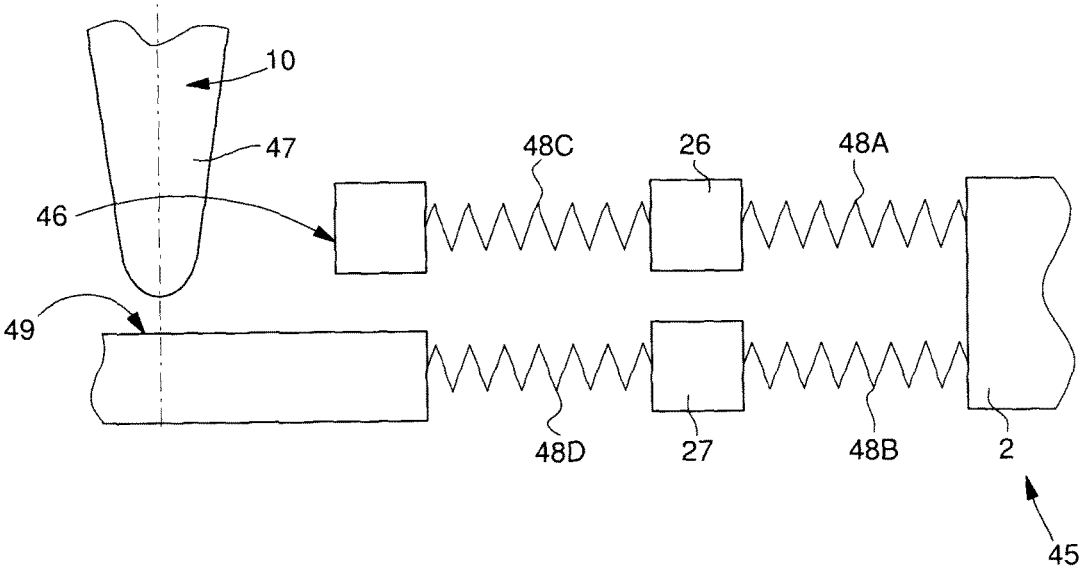
FIG. 3 shows, in a similar manner to FIG. 2, a pivot with a first rotational guide member for radially holding an arbor, suspended from an upper jewel-setting by a first connecting element, said upper jewel-setting being suspended from the plate by a first upper shock absorber at a first upper level, and with a second front guide member for limiting the end of an arbor, suspended from a lower jewel-setting by a second connecting element, said lower jewel-setting being suspended from the plate by a second lower shock absorber at a second lower level.
Figure 4:
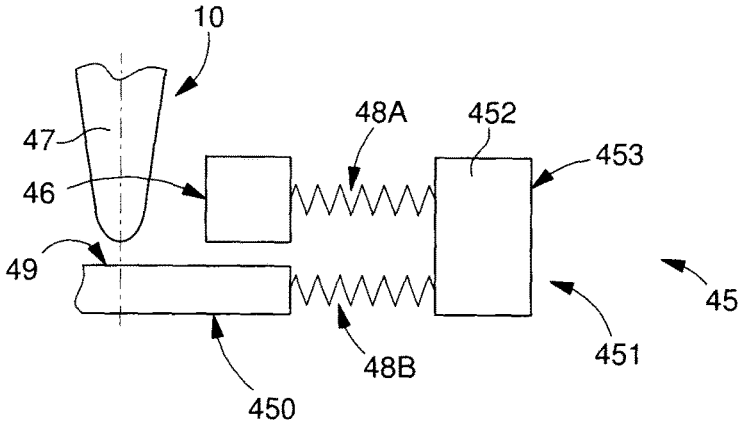
FIG. 4 shows, in a similar manner to FIG. 2, a pivot with a first rotational guide member for radially holding an arbor, suspended from a cabochon by a first upper shock absorber at a first upper level, and with a second front guide member for limiting the stop of one end of an arbor, suspended from the same cabochon by a second lower shock absorber, lower than a second lower level, the cabochon including a centring surface for housing the pivot in a plate.
Figure 5:
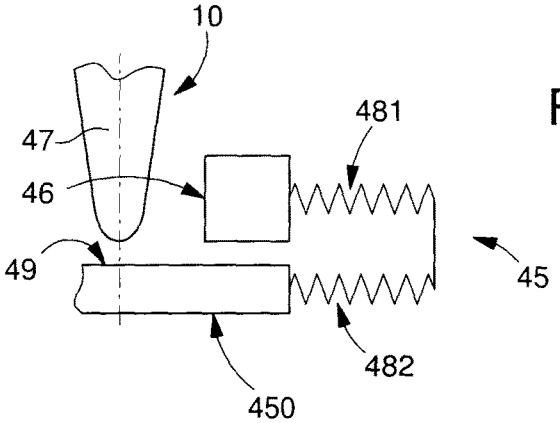
FIG. 5 shows, in a similar manner to FIG. 2, a pivot with a first rotational guide member for radially holding an arbor, suspended from the plate by a first upper shock absorber at a first upper level, and with a second front guide member for limiting the end of an arbor, suspended from the plate at a second lower level by a second lower shock absorber which is integral with said first upper shock absorber, and includes a centring surface for housing the pivot in a plate.
Figure 6:
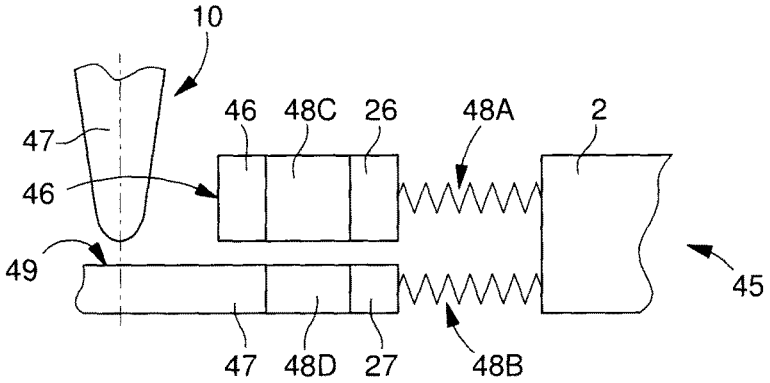
FIG. 6 shows, in a similar manner to FIG. 3, a pivot with, at a first upper level, a first rotational guide member for radially holding an arbor, suspended from an upper jewel-setting by a first connecting element, said upper jewel-setting being suspended from a structural element by a first upper shock absorber, and with, at a second lower level, a second front guide member for limiting the end of an arbor, suspended from a lower jewel-setting by a second connecting element, said lower jewel-setting being suspended from said structural element by a second lower shock absorber.
Figure 7:
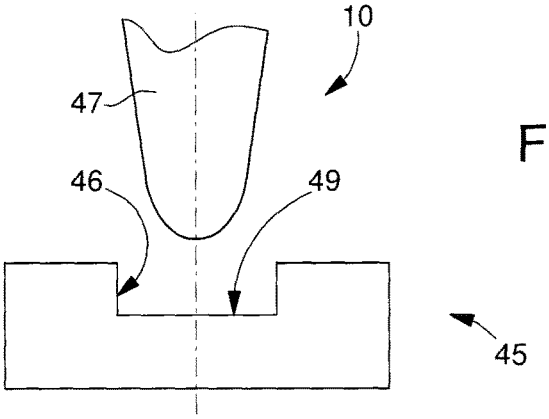
FIG. 7 shows, in a similar manner to FIG. 1, a pivot with a first rotational guide member which forms a single component with a second front guide member.
Figure 8:
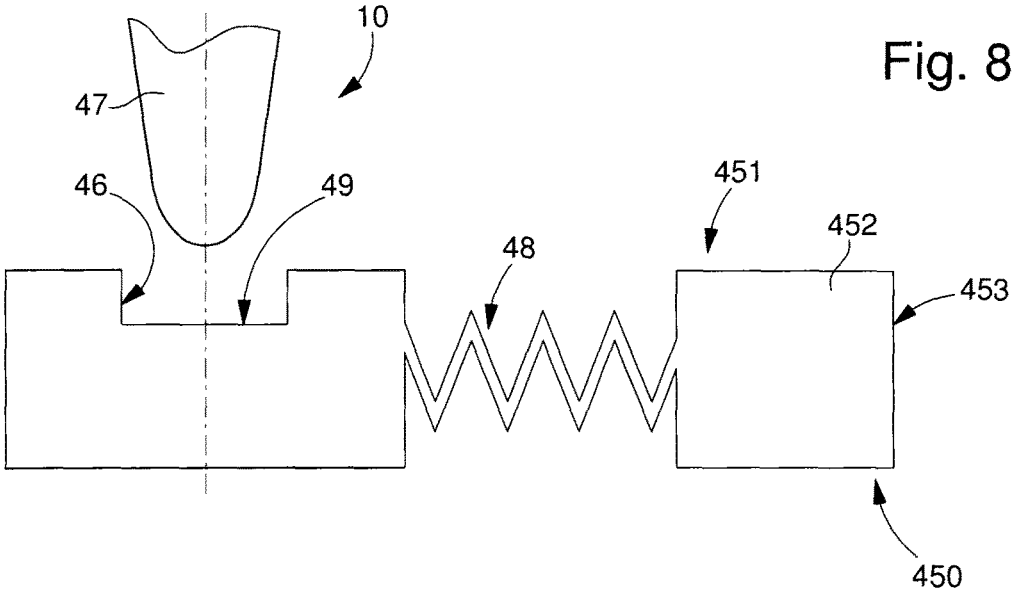
FIG. 8 shows the single component of FIG. 7, suspended by a shock absorber from a cabochon, with which they form a one-piece assembly.

The invention concerns the field of timepiece mechanisms, and more specifically the pivoting of timepiece wheel sets.

The invention concerns a pivot 45 for a timepiece mechanism, including a first rotational guide member 46 for radially holding an arbor 47 in a plate 2 and a second front guide member 49 for axially limiting the end of arbor 47. This pivot 45 includes at least one resilient shock absorber 48, which acts on at least the first rotational guide member 46 and/or the second front guide member 49.

According to the invention, in a first preferred embodiment, this at least one resilient shock absorber 48 is made in a one-piece manner, in a micromachinable material or silicon or quartz or diamond or ruby or corundum, with at least one structural element 451 other than the first rotational guide member 46 and the second front guide 49.

This structural element 451 may consist in particular of a plate, bridge, cabochon or other element.

According to the invention, pivot 45 has a first level and a second level superposed on each other. On the first level the first rotational guide member (46) is suspended from structural element 451 via at least a first shock absorber 48A, and on the second level, the second front guide member 49 is suspended from structural element 451 via at least a second shock absorber 48B.

The invention covers all variants resulting from the one-piece assembly of several elementary functional pivot components.

In particular, "elementary functional components" means:

- the first rotational guide member 46, often formed by a jewel hole in the case of a conventional pivot;
- in the frequent case where lubrication of the arbor is required, an oil pot formed by the space delimited by the generally concave back of first rotational guide member and second front guide member 49;
- the second front guide member 49, generally a jewel with a substantially plane surface;
- a jewel-setting for holding each jewel, either an upper jewel-setting 26 for holding first rotational guide member 46 and a lower jewel-setting 27 for holding second front guide member 49, or a single jewel-setting for holding first rotational guide member 46 and second front guide member 49;
- any rigid or flexible connecting element, a first connecting element 48C between first rotational guide member 46 and upper jewel-setting 26 on the one hand, a second connecting element 48D between second front guide member 49 and lower jewel-setting 27 on the other hand;
- at least one resilient shock absorber 48, which may be divided into an upper shock absorber 48A, and a second lower shock absorber 48B;
- any cabochon 452, which may also be separated into a first upper cabochon and a second lower cabochon;
- plate 2 in which the pivoting occurs.

It is clear that the invention covers a very large number of combinations, depending upon whether all or part of the conventional components of a pivot are formed in a one-piece manner with others, and in particular, with the plate.

In particular, the pivot of the invention may be made on one or several levels.

Figure 9:
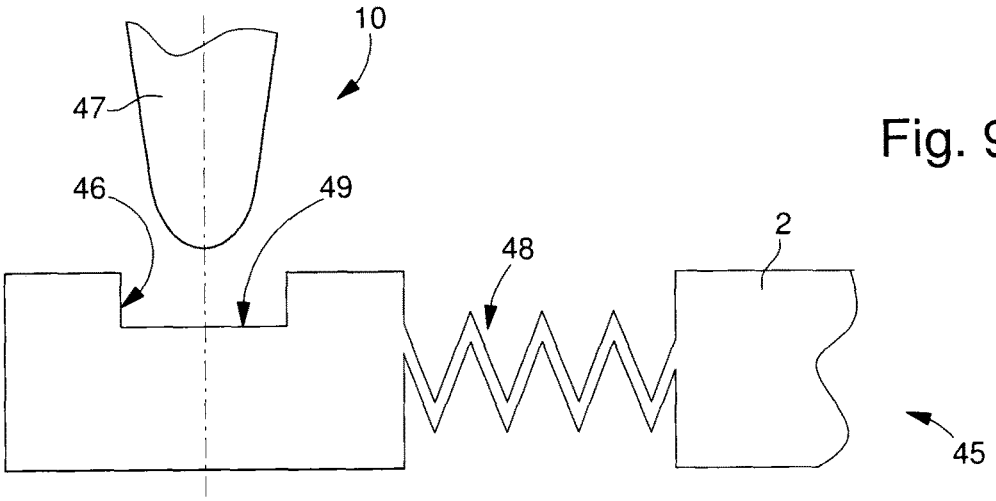
FIG. 9 shows the single component of FIG. 7, suspended by a shock absorber to the plate, with which they form a one-piece assembly.

FIG. 9 illustrates a single level embodiment, with a single component, wherein plate 2 directly incorporates a single resilient shock absorber 48 carrying a single unit, whose profile is adapted to form both first rotational guide member 46 and second front guide member 49.

Given that first rotational guide member 46 and second front guide member 49 are conventionally formed by separate jewels, it is also possible to devise an architecture with two superposed levels, a first upper level supporting first rotational guide member 46, and a second lower level supporting second front guide member 49, as seen in FIGS. 2 to 6, which illustrate non-limiting variants of the invention. An architecture having two levels does not mean that the two levels are separate; links between the two levels may be achieved, for example by joining first rotational guide member 46 and second front guide member 49, or upper jewel-setting 26 and lower jewel-setting 27, or first connecting element 48C and second connecting element 48D, or others, since the links may also be formed between functional components which do not fulfil the same function on each level.

Of course, it is also possible to devise a higher number of levels, but in the case of MEMS fabrication, which is already unable to produce every architecture in an embodiment with two superposed levels, fabrication complexity rapidly becomes a limiting factor. However, the component may be fabricated with the silicon plane parallel to the arbor.

The design and arrangement of the at least one resilient shock absorber 48, and of the at least one connecting element, in flexible form, enables the elements to be differentiated in terms of damping radial and axial accelerations.

Figure 10:
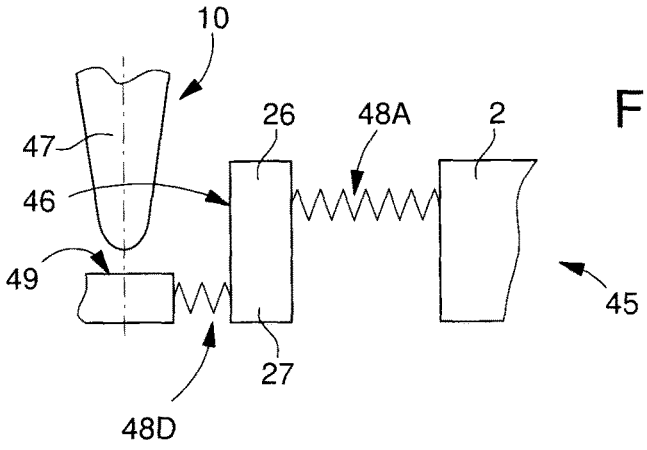
FIG. 10 shows a second front guide member suspended from the lower jewel-setting by a second flexible connecting element arranged to absorb an axial shock in the direction of the arbor, the lower jewel-setting being fixed to an upper jewel-setting which also carries the first rotational guide member, and which is suspended from the plate by a resilient shock absorber preferably intended to absorb shocks having a radial component.

FIG. 10 illustrates an example wherein the second front guide member 49 is suspended from a lower jewel-setting 27 by a second flexible connecting element 48D arranged to absorb an axial shock in the direction of arbor 47, the lower jewel-setting 27 is fixed to upper jewel-setting 26 which also carries the first rotational guide member 46, and which is suspended from plate 2 by a resilient shock absorber 48 preferably intended to absorb shocks with a radial component.

Naturally, the invention also covers the case where a pivot assembly 450, preferably in a single-piece, is housed in a bore or counterbore of a conventional plate. This pivot assembly 450 then includes at least two components made in one-piece with each other, in micromachinable material.

For the sake of simplification, the present description only illustrates a few cases of pivots in a single-piece with the plate, in certain particular architectures, which are in no way limiting.

In a particular embodiment, the at least one resilient shock absorber 48 is made in a single-piece with the second front guide member 49.

In a particular embodiment, the at least one resilient shock absorber 48 is made in a single-piece with the first rotational guide member 46.

In a combined embodiment, the at least one resilient shock absorber 48 is made in a single-piece with the second front guide member 49 and with the first rotational guide member 46.

In a particular embodiment, pivot 45 includes a first level and a second level superposed on each other. On the first level, the first rotational guide member 46 is suspended from said structural element 451 via at least a first shock absorber 48A. On the second level, the first rotational guide member 49 is suspended from said structural element 451 via at least a second shock absorber 48B.

In a particular embodiment, on this first level, the first rotational guide member 46 is suspended from an upper jewel-setting 26 by a first connecting element 48C, the upper jewel-setting 26 being suspended from structural element 451 via the first shock absorber 48A.

In a particular embodiment, the first connecting element 48C is a flexible element.

In a particular embodiment, first rotational guide member 46, upper jewel-setting 26, first connecting element 48C and first shock absorber 48A together form a one-piece component.

In a particular embodiment, on this second level the second front guide member 49 is suspended from a lower jewel-setting 27 by a second connecting element 48D, the lower jewel-setting 27 being suspended from structural element 451 via the second shock absorber 48B.

In a particular embodiment, the second connecting element 48D is a flexible element.

In a particular embodiment, second front guide member 49, lower jewel-setting 27, second connecting element 48D and second shock absorber 48B together form a one-piece component.

In a particular embodiment, upper jewel-setting 26 and lower jewel-setting 27 together form a single rigid component.

In a particular embodiment, first shock absorber 48A and second shock absorber 48B together form a single component.

In a particular advantageous embodiment, first rotational guide member 46, upper jewel-setting 26, first connecting element 48C, first shock absorber 48A, second front guide member 49, lower jewel-setting 27, second connecting element 48D, and second shock absorber 48B together form a single-piece component.

In a particular embodiment, pivot 45 forms an independent pivot assembly 450, and structural element 451 is a cabochon 452 including at least one bearing surface 453 arranged to cooperate with a plate 2.

Preferably, for tribological reasons, to remove or reduce lubrication, at least first rotational guide member 46 or second front guide member 49 includes a guide surface for arbor 47, which is coated with a hard coating or DLC, or similar coating.

In a second embodiment of the invention, pivot 45 for a timepiece mechanism includes a first rotational guide member 46 for radially holding an arbor 47 in a plate 2, and a second front guide member 49 for axially limiting the end of arbor 47, and includes at least one resilient shock absorber 48 acting on at least the first rotational guide member 46 and/or the second front guide member 49. Pivot 45 is characterized in that at least the first rotational guide member 46 or second front guide member 49 is made in a one-piece manner, in a micromachinable material or silicon or quartz or diamond or ruby or corundum, with at least one structural element 451 other than the first rotational guide member 46 and the second front guide 49. In particular, first rotational guide member 46 or second front guide member 49 is made in a single piece with plate 2. Naturally, all the variants described in the first embodiment may be combined with the second embodiment. In the second embodiment, the resilient shock absorber may be driven in or welded, as well as one of the guides of the arbor, if both are not in one-piece with the structural element, particularly plate 2.

This integration of additional elements may be necessary in both embodiments, when the structural element carrying the pivot components is unsatisfactory from the point of view of friction. This does not prevent single-piece manufacture, which guarantees the geometry and shock absorption features of the pivot concerned.

The invention also concerns a timepiece plate 2 including at least one pivot 45 of this type.

In a particular embodiment, plate 2 forms the structural element 451 for at least one pivot 45 comprised therein.

In a particular embodiment, at least the first rotational guide member 46 or the second front guide member 49 is made in a one-piece manner with plate 2 in a micromachinable material or silicon or quartz or diamond or ruby or corundum.

In a particular embodiment, first rotational guide member 46 and second front guide member 49 are both made in a single piece with plate 2.

A preferred application was described above in which both first rotational guide member 46 and second front guide member 49 are carried by at least one resilient shock absorber 48 with main variants wherein:

- either first rotational guide member 46 and front guide member 49 are carried together by at least one resilient shock absorber 48,
- or first rotational guide member 46 and front guide member 49 are carried separately by a shock absorber, which may be a common shock absorber with two bearing surfaces, or multiple shock absorbers, with each guide member being carried by its own shock absorber.

More generally, the invention also concerns the case where only the first rotational guide member 46 or the second front guide member 49 is carried by at least one resilient shock absorber 48 peculiar thereto.

The invention also concerns a mechanical timepiece movement 100 including at least one plate 2 of this type.

The invention further concerns any combinations integrating several conventional pivot components in a single-piece.

The invention further concerns a pivot assembly 450 intended to be placed on or in a plate, said pivot assembly including at least a first rotational guide member 46 for radially holding an arbor 47 in a plate 2 and a second front guide member 49 for axially limiting the end of said same arbor 47, and at least one resilient shock absorber 48. According to the invention, resilient shock absorber 48 is made in a one-piece manner with at least one of these shoulders.

Preferably, resilient shock absorber 48 is made in a one-piece manner with both first rotational guide member 46 and second front guide member 49.

The interface between pivot assembly 450 and plate 2 is formed either by a cabochon 451 or by a resilient shock absorber 81 including a centring surface 482 arranged to cooperate with a housing in a plate 2.

Cabochon 451 confines the first rotational guide member 46 and second front guide member 49 and the at least one resilient shock absorber 48. Preferably the cabochon is in a single-piece with the at least one resilient shock absorber 48.

The invention also concerns a mechanical timepiece movement 100 including at least one plate 2 of this type.

In another particular embodiment of the invention, lower plate 2 and/or upper bridge 3 and/or a frame 17 forms an inseparable single-piece component 20 with at least one shock absorber bearing for receiving a pivot of a component of the mechanism incorporated in a cassette 1, particularly an escape mechanism.

In the particular embodiment of FIG. 1, a cassette 1 includes at least one functional component 10, such as an arbor 47, which is pivotally moveable between a lower pivot 45 integral with plate 2 and an upper pivot integral with a bridge (not shown), and at least one lower pivot 45 or upper pivot 44 is made in a one-piece manner with plate 2 or with a bridge and includes a shoulder of revolution 46 for radially holding an arbor 47 of pivotally moveable functional component 10, and a frontal shoulder 49 for axially limiting the end of arbor 47. Shoulder of revolution 46 and frontal shoulder 49 are preferably both carried by a resilient shock absorber 48 which is also in a single-piece with said shoulders.

The shock absorbers may thus be partially or totally made inside the plate: the shock absorber spring may be made jointly with the plate. One of the two (or both) jewels may be made jointly with the plate. The pivoting then occurs directly in the silicon. The pivot points may be made straight in the silicon with DLC or other surface coatings. There are thus no longer any jewels and the points of rotation are very precisely positioned. The shock absorbers may be made with essentially two-dimensional silicon or similar parts, with the two-dimensional plane perpendicular to the arbor, or with the two-dimensional plane parallel to the arbor.

In an advantageous embodiment, the non-detachable single-piece component such as a pivot 45 or a pivot assembly 450, a plate 2 containing one and/or the other, is made of silicon and the integrated elastic returns means of the non-detachable single-piece component is pre-stressed in a silicon oxide state.

Particular structuring of plate 2 and/or a bridge and/or non-detachable single-piece components can compensate for the effects of expansion of these structural elements or of components of the mechanism. It is, for example, possible to make the plate in silicon, and then oxidise it, for the sake of consistency.

The invention claimed is:

1. A timepiece plate comprising:

at least one pivot for a timepiece mechanism, the pivot including a first rotational guide member for radially holding an arbor in the plate, and a second front guide member for axially limiting an end of the arbor; and at least one resilient shock absorber, including an upper shock absorber and a lower shock absorber, acting on at least the first rotational guide member and/or the second front guide member, wherein the upper shock absorber and the lower shock absorber are made in a one-piece manner by a MEMS or LIGA or lithography manufacturing technology for microcomponents, in a micromachinable material or silicon or quartz or diamond or ruby or corundum with at least one structural element other than the first rotational guide member and the second front guide member such that the upper shock absorber, the lower shock absorber, and the at least one structural element form one piece;

the pivot including a first level and a second level which are superposed, and the first rotational guide member being suspended to the structural element via at least the upper shock absorber on the first level, and the second front guide member being suspended to the structural element via at least the lower shock absorber on the second level;

the plate forming the structural element for at least one of the pivot comprised therein, wherein the first rotational guide member and the second front guide member are both made in a one-piece manner with the plate by a MEMS or LIGA or lithography manufacturing technology for microcomponents, in a micromachinable material or in silicon or quartz or diamond or ruby or corundum, and wherein:

on the first level the first rotational guide member is suspended from an upper jewel-setting by a first connecting element, the first connecting element being a flexible element separate from the upper shock absorber, the upper jewel-setting being suspended from the structural element by the upper shock absorber, or on the second level the second front guide member is suspended from a lower jewel-setting by a second connecting element, the second connecting element being a flexible element separate from the lower shock absorber, the lower jewel-setting being suspended from the structural element by the lower shock absorber.

2. The plate according to claim 1, wherein the first rotational guide member, the upper jewel-setting, the first connecting element, and the upper shock absorber form a one-piece component.

3. The plate according to claim 2, wherein the second front guide member, the lower jewel-setting, the second connecting element, and the lower shock absorber form a one-piece component, and wherein the first rotational guide member, the upper jewel-setting, the first connecting element, the upper shock absorber, the second front guide member, the lower jewel-setting, the second connecting element, and the lower shock absorber form a single-piece component.

4. The plate according to claim 1, wherein the second front guide member, the lower jewel-setting, the second connecting element, and the lower shock absorber form a one-piece component.

5. The plate according to claim 1, wherein the upper jewel-setting and the lower jewel-setting form a single rigid component.

6. The plate according to claim 1, wherein the at least one resilient shock absorber is made in a one-piece manner with the second front guide member.

7. The plate according to claim 6, wherein the at least one resilient shock absorber is made in a one-piece manner with the first rotational guide member, and wherein the at least one resilient shock absorber is made in a one-piece manner with the second front guide member and with the first rotational guide member.

8. The plate according to claim 1, wherein the at least one resilient shock absorber is made in a one-piece manner with the first rotational guide member.

9. The plate according to claim 1, wherein the first rotational guide member and the second front guide member together form a single component.

10. The plate according to claim 1, wherein at least the first rotational guide member or the second front guide member includes a guide surface for the arbor coated with a DLC coating.

11. A mechanical timepiece movement comprising at least one plate according to claim 1.

* * * * *